United States Patent [19]

Wright

[11] Patent Number: 4,772,149

[45] Date of Patent: Sep. 20, 1988

[54] SHEET BINDER MECHANISM

[75] Inventor: David M. Wright, Shrewsbury, Mass.

[73] Assignee: Wright Line Incorporated, Worcester, Mass.

[21] Appl. No.: 35,466

[22] Filed: Apr. 3, 1987

[51] Int. Cl.[4] ..... B42F 3/04; B42F 15/00; B42F 13/16

[52] U.S. Cl. ..... 402/32; 402/51

[58] Field of Search ..... 402/32, 46, 50, 52, 402/54, 56, 51, 53

[56] References Cited

U.S. PATENT DOCUMENTS

| | | | |
|---|---|---|---|
| 619,525 | 2/1899 | Winfield | 402/53 |
| 638,208 | 12/1899 | Amrath | 402/51 |
| 804,007 | 11/1905 | Higginson | 402/51 |
| 831,969 | 9/1906 | Morden et al. | 402/32 X |
| 862,144 | 8/1907 | Dunn | 402/51 |
| 978,922 | 12/1910 | Morehouse | 402/53 |
| 1,071,415 | 8/1913 | Heidel | 402/51 |
| 1,731,156 | 10/1929 | Wolf | 402/32 X |
| 1,865,364 | 6/1932 | Finley | 402/51 |
| 2,212,380 | 8/1940 | Steele | 402/56 |
| 2,862,504 | 12/1958 | Hutzelman | 402/56 |
| 3,348,550 | 1/1967 | Wolf et al. | 402/56 |
| 3,801,175 | 4/1974 | Giulie | 312/184 |
| 3,833,308 | 9/1974 | Seaborn | 402/56 |
| 4,171,854 | 10/1979 | Hedstrom et al. | 312/184 |

FOREIGN PATENT DOCUMENTS

| | | | |
|---|---|---|---|
| 2709889 | 10/1977 | Fed. Rep. of Germany | 402/56 |
| 589194 | 3/1945 | United Kingdom | 402/50 |

*Primary Examiner*—Paul A. Bell

*Attorney, Agent, or Firm*—Milton E. Gilbert; James W. Mitchell

[57] ABSTRACT

A binding mechanism is provided having a plurality of carriers, each supporting a pair of engaging rods, slidably mounted lengthwise of a spine. A pinion member interfacing a plate with gear teeth mounted to one of the pair of engaging rods allows for movement of one of each of the pairs of engaging rods simultaneously.

10 Claims, 3 Drawing Sheets

SHEET BINDER MECHANISM

FIELD OF THE INVENTION

This invention relates to mechanism for binding and filing documents and other loose sheets having holes along their margins.

BACKGROUND OF THE INVENTION

In the prior art, ring binders of the notebook type are typically used in suspension binding systems. Generally, this type of binder has front and rear covers hinged to a spine member carrying two or more sets of normally closed ring halves. To receive loose sheets, the ring halves are separated, and holes of the loose sheets are passed over the open ring halves. An inexpensive snap mechanism provides a snap-action to close and bias the ring halves together.

Ring binders of this prior art type often present problems for binding computer paper in a suspension system because the ring halves do not line up with the holes along the margin of the computer paper. As a result, new holes must be punched through the margin of the computer paper to align with the ring halves which are not adjustable. Therefore, there exists a need for a binding mechanism in which the binders per se can be adjusted to align with the holes along the margins of the computer paper whatever their spacing.

SUMMARY OF THE INVENTION

In accordance with the present invention, a binding mechanism, particularly suited for binding computer paper in a suspension system, is provided. The binding mechanism comprises a plurality of sheet retaining members which are supported by a spine. Preferably, each retaining member comprises a pair of engaging rods having a straight hanging portion. The straight hanging portion allows the retained sheets to hang uniformly and prevents the sheets from sliding toward the mating portion of the pair of rods where sheets may spill out of the binder if improperly closed. Each pair of rods are mounted to a carrier which is slidably mounted along the length of the spine. Mounting the carrier in this manner allows the engaging rod to be aligned with any one of a series of holes along the common marginal edge of the loose sheets.

To receive loose sheets, a handle is rotated causing one rod from each pair of engaging rods to slide in a direction that is transverse of the length of the spine. The handle is connected to a pinion member which extends along the length of the spine and interfaces with gear teeth secured to each sliding rod.

The above and other features of the invention including various novel details of construction and combinations of parts will now be more particularly described with reference to the accompanying drawings and pointed out in the claims. It will be understood that the particular binding mechanism embodying the invention is shown by way of illustration only and not as a limitation of the invention. The principles and features of this invention may be employed in varied and numerous embodiments without departing from the scope of the invention.

DETAILED DESCRIPTION OF THE INVENTION

Figure 1:
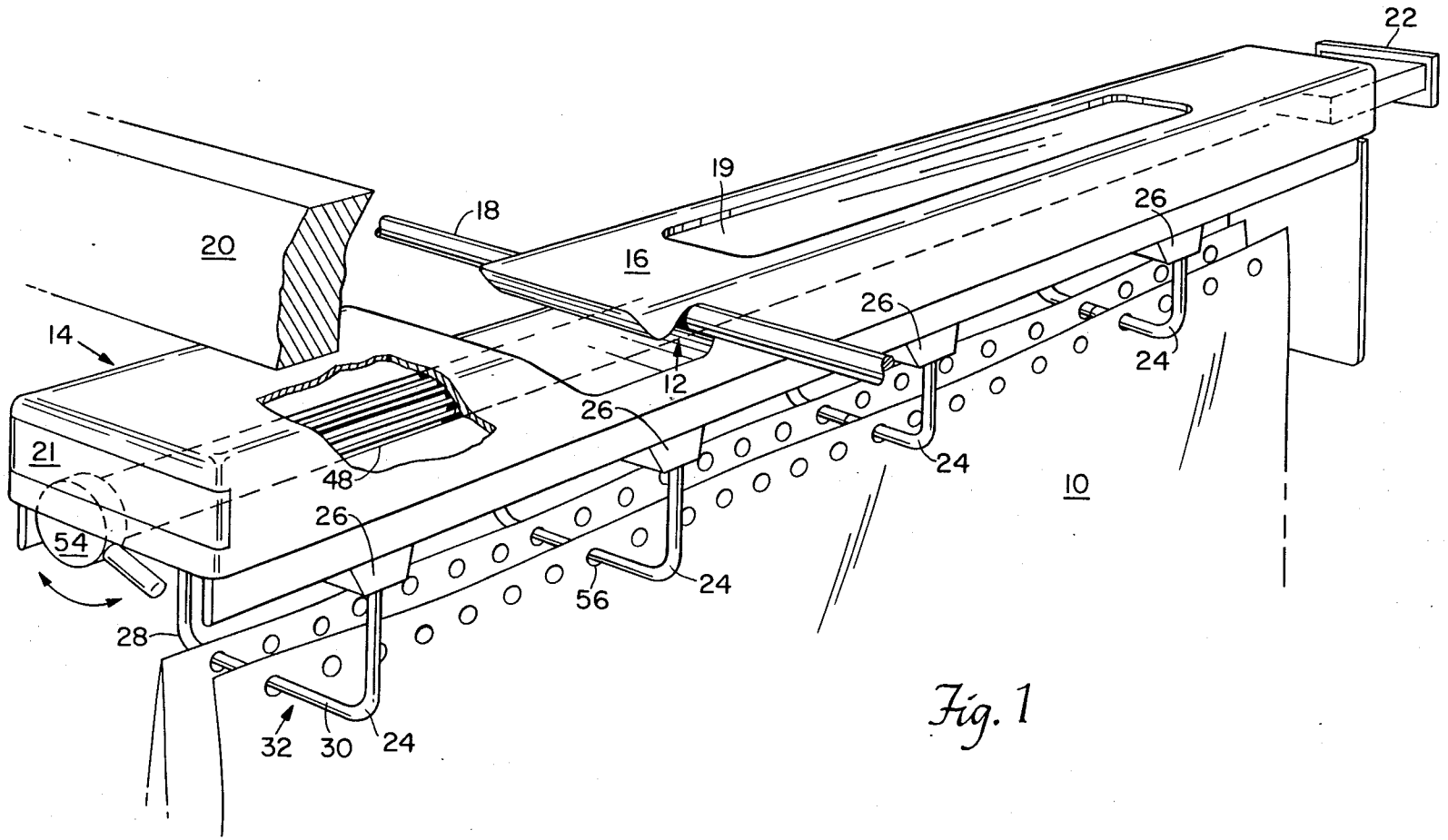
FIG. 1 is a perspective view of a sheet binding mechanism embodying the invention.

In FIG. 1, a binding mechanism is shown for binding loose-leaf sheets such as computer printout paper which is folded accordionwise into a plurality of folds or sheets. For simplicity, three such sheets 10 are shown.

In order to adapt the binding mechanism to a suspension filing system, a hook portion 12 is formed adjacent to a section 14 along a spine 16 of the mechanism. When the binding mechanism is suspended from a hanger or retaining member 18, which is engaged within the hook portion 12, the section 14 abuts a brace 20, generally part of a storage cabinet or the like, and which extends transversely across the length of the binding mechanism. A depression 19 for receiving indicia may be formed along the spine.

The binding mechanism may alternately be suspended by hanger tabs 21 and 22 which are located at each end of the spine 16 to allow the binding mechanism to be suspended in an ordinary file cabinet or desk drawer. Preferably, the hanger tabs 21 and 22 are attached to the spine 16 in such a way that they may be extended from the spine 16 for suspension in an ordinary filing cabinet and retracted into a slot (not shown) within the spine 16 when they are not used. FIG. 1 shows the tab 22 in an extended position.

In accordance with the present invention, loose-leaf sheets are retained by a plurality of sheet retaining members 24, each supported by a carrier 26 secured to the spine 16. Preferably, each retaining member 24, as shown in FIG. 1, comprises a pair of engaging rods 28 and 30 together forming a straight hanging portion 32 for hanging the loose-leaf sheets.

Figure 2:
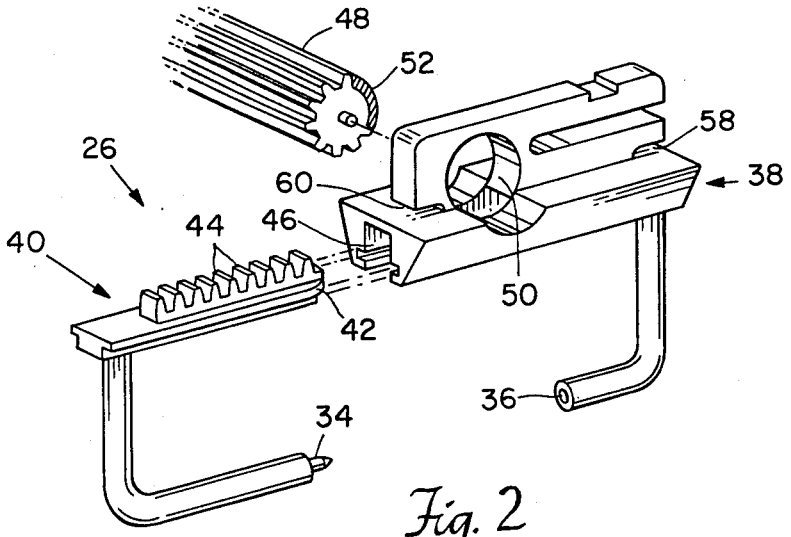
FIG. 2 is an exploded perspective view of a sheet carrier of the binding mechanism shown in FIG. 1.
Figure 4:
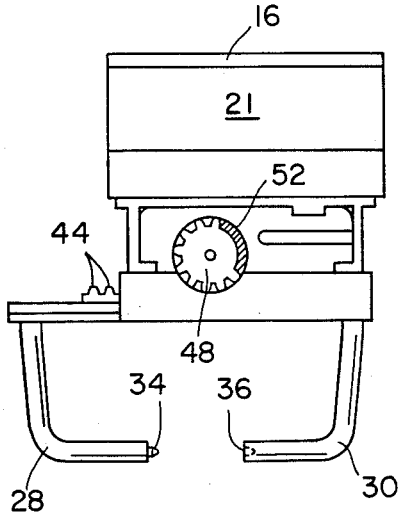
FIG. 4 is a side view of the binding mechanism in an open position.

As shown in FIGS. 2 and 4, at the end of one of the engaging rods, a pin 34 is provided, which projects into an opening 36 in the other rod. The mating of the pin 34 within the opening 36 of the other rod provides for alignment of the two rods 28 and 30 and prevents paper from sliding through the two rods 28 and 30 if the rods are not perfectly engaged.

Figure 3:
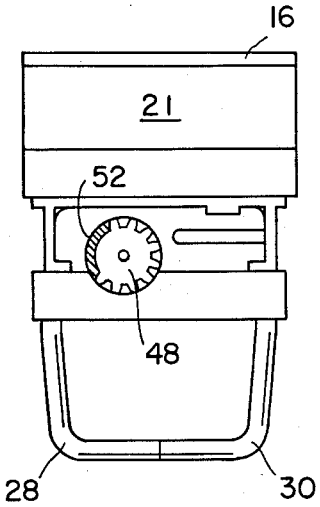
FIG. 3 is a side view of the binding mechanism in a closed position.

As shown in FIG. 2, each carrier 26 comprises two members; a stationary member 38 and a sliding member 40. The sliding member has a plate portion 42 with gear teeth 44 and is constructed to slide within a cavity 46 of the stationary member 38. A pinion 48 extends lengthwise of the whole spine and is fitted through a hole 50 in the stationary portion 38 of each carrier 26 interfaces with the teeth 44 of each sliding member 40. By rotating the pinion 48, the sliding member 40 is incrementally moved in a direction transversely of the spine 16. As a result, the engaging pair of rods open and close as shown in FIGS. 3 and 4. Preferably, a stop 52 is provided on the pinion 48 for limiting the separation of the pair of rods 28 and 30 to prevent the sliding member 40 from becoming disengaged from the stationary member 38.

Referring back to FIG. 1, the broken-away section and the phantom lines indicate that the pinion member 48 extends along the length of the spine. As seen in FIG.

5, it fits through a hole in each carrier member. Rotating a handle 54 fixed to the end of the pinion member enables the pinion 48 to move each sliding member 40 of the plurality of carriers 26 simultaneously.

Figure 5:
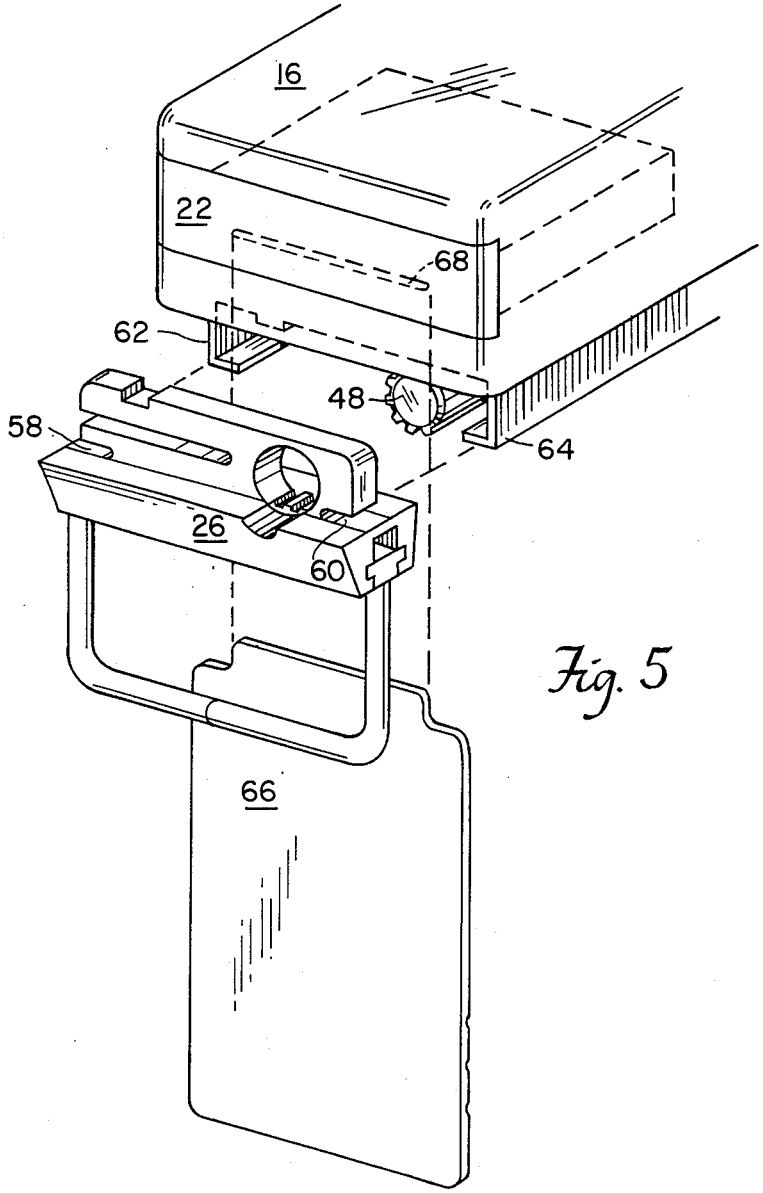
FIG. 5 is a partially exploded perspective view of the binding mechanism embodying the present invention.

In order to align the pair of engaging rods 28 and 30 with a hole 56 (FIG. 1) along the marginal edge of the sheets, each carrier 26 is slidably mounted lengthwise of the spine 16. As shown in FIG. 5, slots 58 and 60 formed in each side of the stationary member 38 of the carrier 26 are positioned to slide along rail members 62 and 64 attached to the spine 16. Preferably, a stopper 66, which is fitted to a slot 68 at the end of the spine, 16 can be removed to enable additional carriers to be added or removed from the binding mechanism.

The present invention provides several advantages over conventional three-ring binders or similar binding mechanisms used for retaining computer paper. For example, the sheet retaining members of the present invention can be aligned to pass through holes commonly found along the margin of computer paper which are not spaced for conventional three ring binders.

Another advantage of the present invention is that the sheet retaining members, are incrementally moved by turning a handle rather than being engaged by a spring or tension means as in conventional binders. Thus, the "mouse trap" effect which can catch a finger is eliminated.

Additionally, the present invention is more aesthetically appealing than a prior art mechanism because the straight hanging portion causes the corners of all of the sheets to be uniformly aligned. The hanging portion also limits the amount of sheets that might slip through the retaining members if for some reason the retaining members should become separated while the mechanism is suspended.

While the invention has been particularly shown and described with reference to a preferred embodiment thereof, it will be understood by those skilled in the art that various changes in form and detail may be made therein without departing from the spirit and scope of the invention as defined by the appended claims.

I claim:

1. A binding mechanism comprising:

a spine, a plurality of sheet retaining members, each retaining member comprising a pair of engaging rods having a straight hanging portion for hanging a plurality of loose sheets;

a plurality of carriers, each carrier supporting a pair of engaging rods, slidably mounted lengthwise of the spine for aligning the pairs of engaging rods with a series of holes along the common marginal edge of the plurality of loose sheets;

a plurality of plates with gear teeth on one face of the plate, each secured to one of each of the pairs of engaging rods; and a pinion member extending longitudinally of the spine for interfacing the gear teeth of the plate for simultaneously moving one of each of the pairs of engaging rods incrementally in a direction transversely of the length of the spine.

2. A binding mechanism as claimed in claim 8 wherein the pinion member has stop means for limiting the incremental movement of the moving rods.

3. A binding mechanism as claimed in claim 1 further comprising a handle for rotating the pinion member.

4. A binding mechanism as claimed in claim 8 wherein the spine comprises hanger tabs which extend from the spine for enabling the binder mechanism to be hung in an ordinary file cabinet.

5. A binding mechanism as claimed in claim 1 wherein the spine comprises a hook section for engaging a retaining member.

6. A sheet binding mechanism comprising:

a spine;

sheet engaging means comprising a plurality of pairs of aligned rods, one rod being moveable and the other stationary, the rods being engageable in the series of holes spaced along the common marginal edge of a plurality of sheets;

a carrier member mounting each pair of rods, each carrier member having a bar with gear teeth connected to each moveable rod;

an elongated driving gear longitudinally disposed lengthwise of the spine and engageable with the gear teeth;

rotating means for rotating the driving gear to simultaneously move each movable rod toward and away from its paired stationary rod to selectively engage and disengage the loose sheets; and means mounting the carrier members for sliding movement lengthwise of the spine to permit the pairs of rods to selectively engage and disengage different holes in the sheets.

7. A sheet binding mechanism as claimed in claim 6 wherein the elongated driving gear has stop means for limiting the movement of the movable rod.

8. A sheet binding mechanism as claimed in claim 6 wherein the rotating means comprises a handle attached to the elongate drive gear.

9. A sheet binding mechanism as claimed in claim 6 wherein the spine comprises hanger tabs which extend from the spine for enabling the binder mechanism to be hung in an ordinary file cabinet.

10. A sheet binding mechanism as claimed in claim 6 wherein the spine comprises a hook section for engaging a retaining member.

* * * * *